US005118037A

United States Patent [19]

Ekegren

[11] Patent Number: 5,118,037

[45] Date of Patent: Jun. 2, 1992

[54] RECYCLING RECEPTACLE

[76] Inventor: Robert D. Ekegren, 4637 Heritage Hills Dr., Bloomington, Minn. 55437

[21] Appl. No.: 719,372

[22] Filed: Jun. 24, 1991

[51] Int. Cl.[5] ..... B65D 91/00

[52] U.S. Cl. ..... 232/43.1; 232/43.2; 312/200

[58] Field of Search ..... 232/43.1, 43.2; 312/309, 200, 328, 199

[56] References Cited

U.S. PATENT DOCUMENTS

| | | | |
|---|---|---|---|
| 1,281,587 | 10/1918 | Kovachevich | 232/43.2 |
| 1,647,275 | 11/1927 | Cursons . | |
| 2,125,122 | 7/1938 | Mongiello | 232/43.2 |
| 3,008,788 | 11/1961 | Garner | 312/328 |
| 3,893,615 | 7/1975 | Johnson | 232/43.2 |
| 4,002,382 | 1/1977 | Wolf et al. | 312/328 |
| 4,126,241 | 11/1978 | Klosk | 232/43.2 |
| 4,660,758 | 4/1987 | Tavel et al. | 232/43.2 |
| 4,860,910 | 8/1989 | Zipper | 232/43.1 |
| 4,893,722 | 1/1990 | Jones | 232/43.1 |
| 4,941,653 | 7/1990 | Sterner, Jr. | 232/43.1 |

*Primary Examiner*—Renee S. Luebke
*Assistant Examiner*—Michael Milano
*Attorney, Agent, or Firm*—Grady J. Frenchick

[57] ABSTRACT

A recycling receptacle for storing and receiving several types of refuse comprising a rectangular housing having a top panel, a front panel, a bottom panel, a back panel and first and second end or side panels. A plurality of input/output doors or ports are located on the front panel of the container and a newspaper shelf is accessible by an opening in the front panel. The interior of the housing is divided so that approximately one-half to three-fourths of the interior space or volume is accessible by the input and output doors in the front panel and the remaining interior space is accessible from an input door in the first end panel.

8 Claims, 3 Drawing Sheets

RECYCLING RECEPTACLE

TECHNICAL FIELD

This invention relates to receptacles or containers for the receipt and storage of various types of materials which are to be recycled. More particularly, this invention relates to cabinets or storage devices for receiving and storing a multiplicity of related and unrelated recyclable materials. Yet more particularly, this invention relates to a multiple compartment, multiple input/output, refuse container for separate receipt and separate storage of various types of recyclable materials such as glass, metal, plastics or newspapers.

BACKGROUND OF THE INVENTION

U.S. Pat. No. 992,006 to L. Kubersky et al. describes a top-loading, compartment receptacle. The Kubersky receptacle empties from its bottom. U.S. Pat. No. 1,281,587 to J. Kovachevich is also a top-loading waste receptacle for domestic use. Kovachevich discloses multiple rubbish units which are connected together depending upon the number and types of materials to be stored.

U.S. Pat. No. 3,720,346 to David C. Cypher discloses a cylindrical compartmentalized trash receptacle. The receptacle of Cypher is compartmentalized by a removable interior partition comprising a plurality of individual panels which move radially and are edge-connected along a single axis or hinge.

U.S. Pat. No. 3,856,173 to Loryn B. Dean et al. is a multiple container trash receptacle, the multiple, individual trash containers being transported by a rack.

U.S. Pat. No. 3,893,615 to William R. Johnson is a multiple compartment refuse container which loads from the top and unloads from its front. Johnson discloses multiple individual internal compartments of substantially equal size.

U.S. Pat. No. 3,904,218 to Eleanor E. Kostic is a bullet-shaped or cylindrical complimentary trash can unit. The unit of Kostic is comprised of complimentary sections or segments such as triangles or squares.

U.S. Pat. No. 4,801,034 to Laura Sandomeno is a single structure for storing recyclable trash materials. The structure of Sandomeno is divided into a plurality of compartments, each of which is adapted to receive a removable receptacle.

U.S. Pat. No. 4,834,253 to David R. Crine discloses a circular or cylindrical recycling container unit which has a plurality of inner vessels hitting substantially within the outer vessel.

U.S. Pat. No. 4,834,262 discloses a square trash separation container which has a plastic bag retaining mechanism adjacent its opening. Multiple plastic bags are used to secure and store recyclable trash.

U.S. Pat. No. 4,893,719 to John J. Lombardi discloses another variety of compartmentalized trash containers comprising three separate compartments which "nest" to form a rectangular-shaped container.

U.S. Pat. No. 4,893,722 to Gregory H. Jones discloses a segregating waste receptacle having separate upper and lower compartments. The lower compartments of Jones are connected to the exterior by a chute which runs through the upper compartment.

U.S. Pat. No. 4,905,853 to Glenn G. Strawder discloses a cylindrical compartmentalized receptacle which has a plurality of arms to divide the interior into defined open spaces. Plastic bags are placed around the arms of Strawder and into the open spaces to receive and hold material which is to be disposed.

None of the above patents, alone or in combination, disclose or suggest the present invention.

BRIEF DESCRIPTION OF THE INVENTION

Briefly, in one aspect, the present invention is a receptacle, cabinet, or container for storing and receiving several types of refuse comprising a rectangular housing having a top panel, a front panel, a bottom panel, a back panel (which optionally may comprise two individual panels or divided panels) and first and second end or side panels. There are a plurality of input/output doors or ports located on the front panel of said container. The input doors extend approximately one-half to three-quarters of the horizontal length of the panel. In a preferred practice of this invention, input ports or doors are located adjacent the top panel of the container substantially in a single line and output ports or doors are located beneath the input doors.

A container of this invention further includes a horizontally disposed storage shelf (e.g., for newspapers) accessible by an opening in the front panel. The opening is defined by and is located adjacent to and at the intersection of the first end panel and the top panel. The first end panel comprises two centrally or medially located input doors leading to the interior of said container. Below the centrally disposed input doors in said first panel is an output door which is vertically hinged, preferably adjacent the back panel. The interior of this container is divided so that approximately one-half to three-fourths (preferably two-thirds) of the interior space or volume is accessible by means of the input and output doors in the front panel and, the remaining interior space is accessible from the input doors in the first end panel.

BRIEF DESCRIPTION OF THE DRAWINGS

A better understanding of the present invention as well as its objectives and advantages will become apparent upon consideration of the detailed description thereof, especially when taken with the accompanying drawings, wherein like numerals designate like parts throughout, and wherein.

DETAILED DESCRIPTION OF THE DRAWINGS

Figure 1:
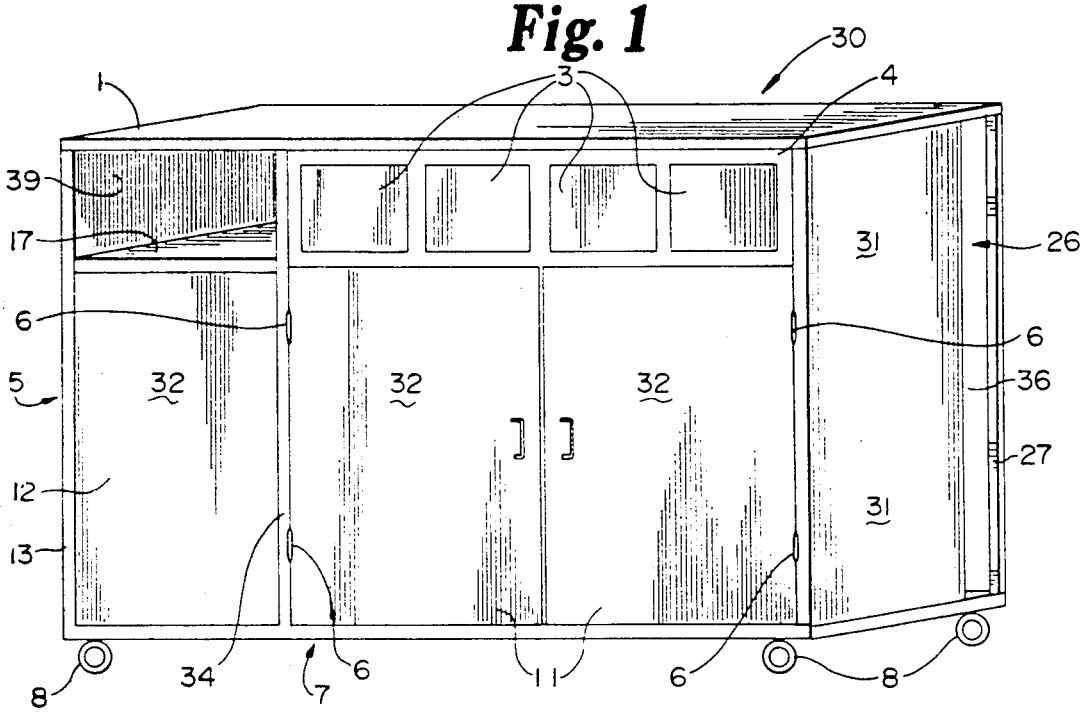
FIG. 1 is a perspective view of an embodiment of the present invention.
Figure 2:
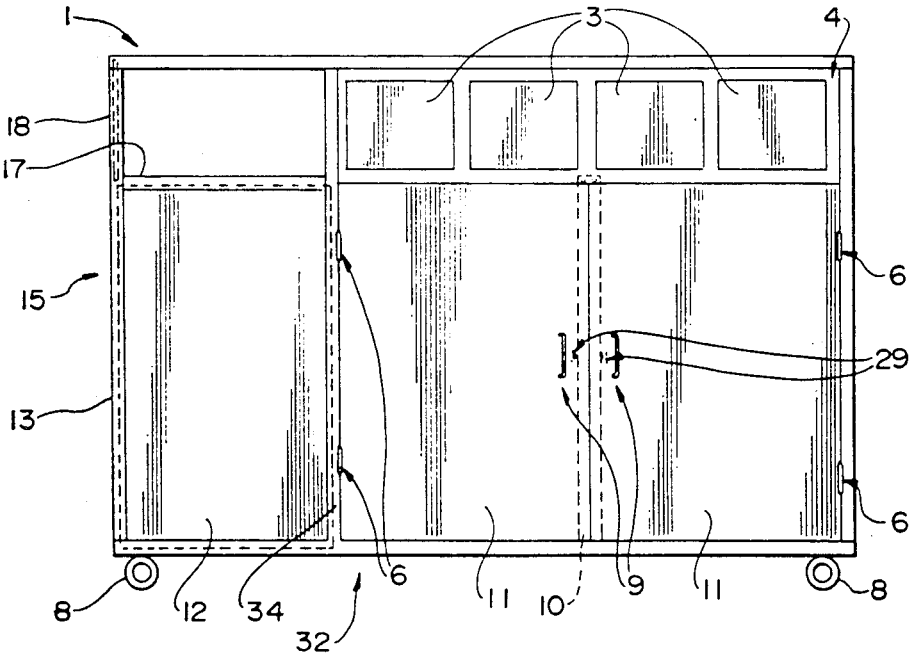
FIG. 2 is a front plan view of the embodiment of the invention depicted in FIG. 1.

Reference is now made to the figures wherein like numerals are used to refer to like features of the invention in the various views. Illustrated in FIGS. 1 and 2 are a container or cabinet 30 of the present invention Cabinet 30 comprises a rectangular, elongate housing having a top panel 1, first and second side or end panels 5, 31, respectively, bottom panel 7, front panel 32 and back panel 26. In one embodiment of the invention, bottom panel 7 and back panel 26 are rectangular, flat panels with essentially no distinguishing external features In a preferred embodiment, back panel 26 comprises first and second panels (26 and 27) which define a large, narrow vertical space 36 usable for storing articles such as sheet material Front panel 32 has, in this embodiment, four downwardly-flapping refuse input doors 3. The precise number of input doors may vary. Approximately one-half to three-fourths (preferably two-thirds) of the horizontal length of the top portion of front panel 32 has input doors 3 therein. Doors 3 are hinged at the top so as to permit refuse to be placed within container 30 by simply pushing doors 3 from the front. Doors 3, primarily for aesthetic reasons, are interiorly hinged within container 30. Although not shown, in a preferred embodiment, doors 3 may have signs placed thereon. This permits multiple varieties of closely related recyclable refuse to be collected and stored therein. Thus, for example, there may be indicia on doors 3 indicating "glass", "PET" (polyethyleneterephehlate), "cans-metal", and, for example, "cans-aluminum". In this manner, multiple varieties of related materials may be separately collected and stored. Different colors of glass also may be collected, with doors 3 labeled accordingly.

Front panel 32 further includes a plurality of larger, substantially rectangular refuse removal doors 11. Refuse removal doors 11 are located beneath refuse input doors 3. Refuse removal doors 11 in combination with refuse input doors 3 define approximately one-half to three-fourths (preferably two-thirds) of the total area of front panel 32. Refuse input doors 11 are hinged (by vertical hinges 6) adjacent end panel 5, and on vertical support 34. Vertical supports 34 physically separates top panel 1 and bottom panel 7 as well as providing a convenient location on which to hinge doors 11. Doors 11 provide convenient access to the interior of container 30 permitting the retention therein of approximately the same number of storage means (container or bags) as there are refuse input doors 3. Doors 11 have handle means 9 which, in this embodiment, are wire pulls. Lastly, doors 11 close upon and are also supported by interior vertical support 10 (shown in phantom in FIG. 2).

In upper left one-third of front panel 32 is opening 39 into which, for example, newspapers or other flat materials may be placed. Opening 39 provides access to horizontal interior shelf 17 on which bulky or flat items (or newspapers) may be stored for future processing. The remainder of front panel 32 (extending for approximately one-third of its horizontal length) is lower left panel 12 which is retained by exterior vertical support 34, bottom panel 7, the underside of shelf 17 and end vertical support 13. The perimeter of panel 12 is shown in phantom (FIG. 2) because the panel, itself, is held in place by grooves notched in the respective support structures. Similarly, refuse removal doors 11 abut against interior vertical member 10 (shown in phantom in FIG. 2) to which they are latched. Front flap frame 4 completes front panel 32 and provides support for the interior hinges for flap doors 3. Optional wheels 8 mounted in bottom panel 7 provide mobility to the entire structure.

Latches 29 hold front panel refuse removal doors 11 against interior vertical support 10 (shown in phantom). Latches 29 (which are optional) may be selected to provide restricted access (if desired) to the interior of the cabinet 30. In the embodiment shown in FIGS. 1 and 2, the preferred approximately two-thirds of the interior volume of cabinet 30 are available for receipt and storage of recyclable refuse such as plastic, steel and aluminum cans. The remaining approximately one-third of the volume is reserved for receipt and storage of other, larger recyclables such as newspapers. Convenient, refuse-sized access ports, refuse inputs, or doors are provided for all material(s) which are to be received for recycling. These convenience features are particularly advantageous in high volume, high traffic areas where the time necessary to decide where specific types of refuse are to be placed is minimal. In the utilization of this invention, significant savings of time and encouragement of collection of recyclable materials are obtained.

Figure 3:
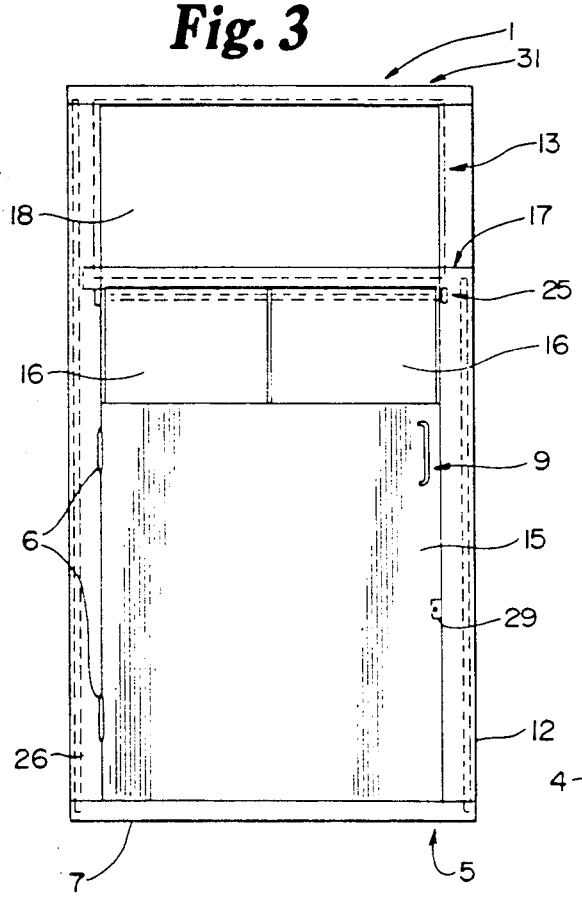
FIG. 3 is a first end or side plan view of the embodiment of the invention shown in FIG. 1.

FIG. 3 is a detailed view of first end or side panel 5. Side panel 5 includes upper exterior defining panel 18 which defines interior opening 39 (not shown), two side flaps or doors 16 and end panel refuse removal door 15. Side flaps 16, in this embodiment, are suspended by a one-fourth inch threaded steel rod 25 (shown in phantom). Threaded steel rod 25 permits side flaps or doors 16 to be pushed inward in order to place recyclables within cabinet 30. Side panel refuse removal door 15 permits access to the interior of cabinet 30. Door 15 is hinged (by hinges 6) adjacent its perimeter closest to back panel 26. Side door clasp or latches 29 in conjunction with wire pull 9 provide convenient restrictive access to the interior of cabinet 30. The edges or perimeters of lower left panel 12, back panel 26 and side panel 18 are shown in phantom due to the fact that they are retained in the respective support members indicated by grooves therein.

Figure 4:
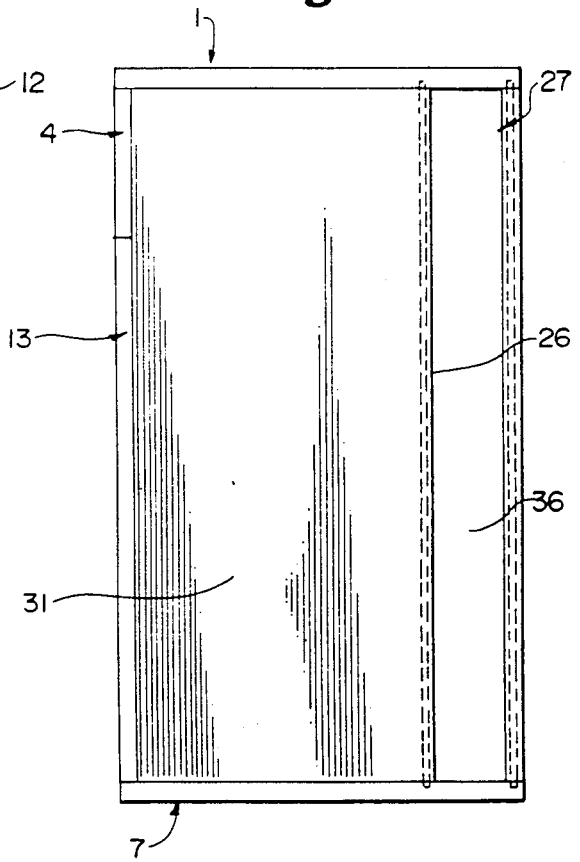
FIG. 4 is a second end or side plan view of the embodiment of the invention depicted in FIG. 1.

FIG. 4 illustrates second side or end panel 31. As shown, end panel 31 is defined by bottom 7, top panel 1 and right end vertical support 13 and vertical refuse input door frame 4. First or interior back panel 26 is slightly inset from the edge of second panel 31 and could be constructed so as to lie in a groove cut therein. Also shown in FIG. 4 (in phantom) is a second, or exterior panel 27 which, in conjunction with first back panel 26 (also shown in phantom) defines an optional interior space 36 behind the right side compartment of cabinet 30. Interior space 36 could be used to retain materials that are in sheet form. If optional space 36 is not desired, then only a single back panel (e.g., 26 or 27) would be utilized. The divided back panel and the space they provide are preferred embodiments of this invention.

Figure 5:
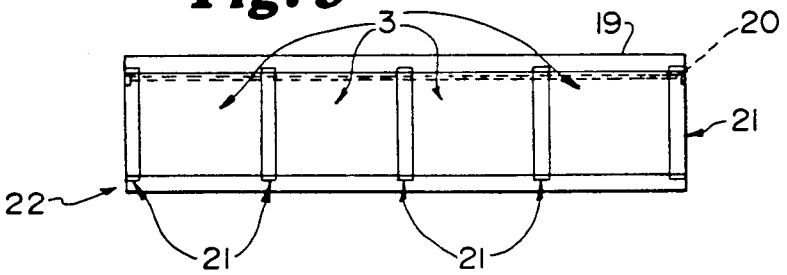
FIG. 5 is a detail of the upper portion front of the embodiment of the invention shown in FIG. 1.

FIG. 5 shows a detail of the front flap frame designated at 4 in FIGS. 1 and. Vertical support pieces 21 separate and provide support for refuse input doors 3. Completing refuse input door frame designated 4 is top piece 19. Shown in phantom is ¼ inch threaded steel rod 20 on which doors 3 are suspended and upon which doors 3 are hinged.

Figure 6:
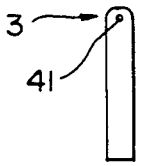
FIGS. 6 and 7 are detailed views of the doors or flaps of the invention shown in FIGS. 1 and 2.
Figure 7:
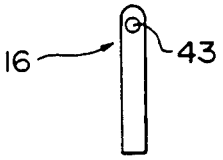

FIG. 6 is a sectional detail of downward flapping refuse input door 3. FIG. 7 is a similar sectional detail of second side flap 16. The rounded or curved top segments of doors 3 and 16 permit the doors to swing about their suspension axes in the panels in which they are respectively located. Holes 41, 42 are drilled to permit steel rod 20 to provide a pivot means therefor.

Figure 8:
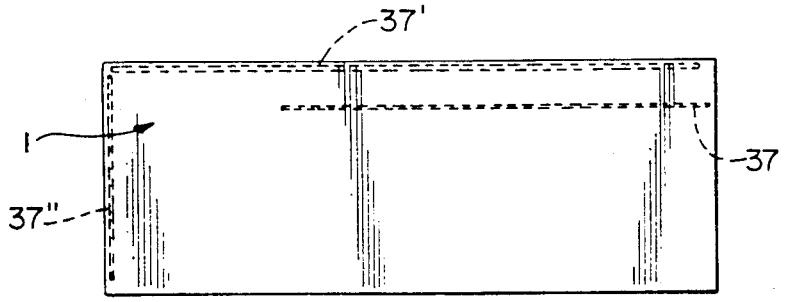
FIG. 8 is a plan view of the top panel of the invention depicted in FIG. 1.

FIG. 8 is a plan view of top panel 1 showing (in phantom) interior dado cut 37, 37' and 37''. Dado cuts 37, 37', and 37'' are of sufficient width so as to permit the joining of top 1 with the respective interior panels which are generally of approximately one-fourth inch in thickness. The interior dado cut designated 37 would be used to retain optional first back panel 26, if a divided back panel is employed. Dado cut 37' would be used to hold second back panel 27. Dado cut 37'' may be needed for first side panel 5.

Figure 9:
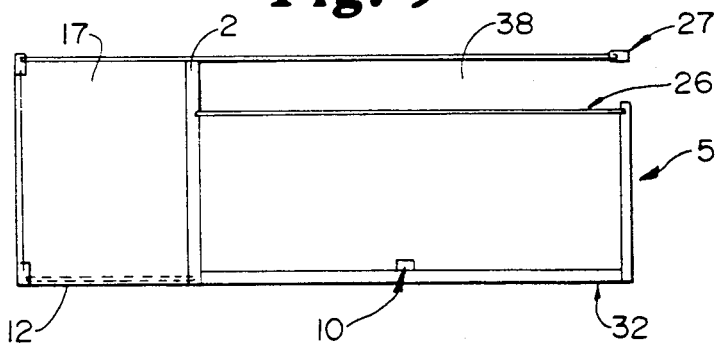
FIG. 9 is a plan view of the interior of the invention with the top panel removed.

FIG. 9 is a view of the cabinet with top panel 1 removed. Divider 2 divides the interior of cabinet 30 into the preferred two-thirds and one-third volume discussed above. First back panel 26 provides a space 38 between the main refuse storage volume and a second back panel 27. Panel 26 also serves to keep refuse contained in the main body of the cabinet 30 disposed toward refuse removal doors 11. This makes removal of stored refuse easier.

Figure 10:
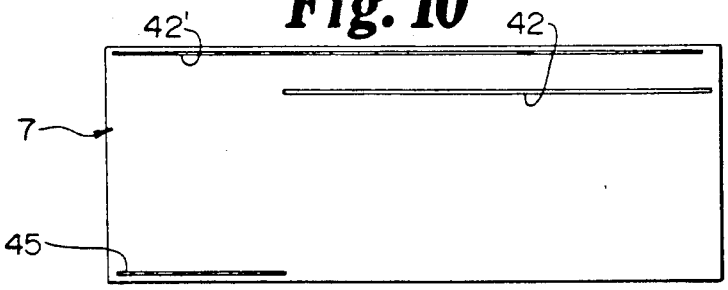
FIG. 10 is an inside plan view of the bottom panel of the invention shown in FIG. 1.

FIG. 10 is an inside top view of bottom panel 7 showing the dado cuts 42, and 42' for joining the corresponding panels which cooperate therewith as shown in FIG. 8, above. Dado cut 45 is the location for the bottom of first end panel 5.

The preferred material of which the present invention is made is wood. Generally speaking, various panels are preferably made from one-fourth inch thick hardwood up to and including three-fourths inch thick plywood. Paper or fiber-based materials also may be employed. The thickness of the panels will be determined by the particular material selected and consideration of cost. Fiber board, veneers, and various well-known wood products are preferred construction materials for the present invention. The present invention may also be made from thermo-plastic polymeric materials. Depending upon the particular application, such material may be less costly and lighter in weight than wood. The basic construction parameters employed in the above description would be equally applicable to utilization of, for example, polypropylene panel as opposed to the wood, veneers, and plywood materials described for utilization herein.

Numerous characteristics and advantages of the invention covered by this document have been set forth in the foregoing description . It will be understood, however, that this disclosure is, in many respects, only illustrative. Changes may be made in details, particularly in matters of shape, size, and arrangement of parts without exceeding the scope of the invention. The invention's scope is, of course, defined in the language in which the appended claims are expressed.

What is claimed is as follows:

1. A multiple compartment refuse container particularly useable for receiving and storing refuse and newspapers which are to be recycled comprising:

a rectangular housing having a front panel, a back panel, a top panel, a bottom panel, and first and second end panels, said front panel comprising:

a multiplicity of downward flapping refuse input doors, said doors being hinged adjacent said top panel and;

two or more substantially larger, rectangular refuse removal doors, located below said refuse input doors, one of said removal doors being hinged upon one of said end panels, the other said door being hinged upon a vertical support which divides the front panel from one-half to three-fourths of the horizontal length of said front panel said front panel further comprising:

a rectangular opening located adjacent said first end panel and said top panel, said opening providing access to an interior horizontally disposed shelf;

said first end panel having an input flap door centrally hinged on said panel and a larger removal door located below said input door wherein the container is interiorly divided so that the front panel doors provide access to from one-half to three-fourths of the volume of the container and the first end panel doors provide access to the remainder of the interior volume.

2. A refuse container according to claim 1 wherein the back panel comprises first and second vertical panels, said first panel being set inward from the rear edge of the top and bottom panels and the second panel being set adjacent the edge of the bottom and top panels so that said first and second panels define a vertical, elongate storage space.

3. A refuse container according to claim 1 wherein the first end panel comprises two centrally located input doors which provide access to the interior of said container, therebeing located below the input doors a single, larger output door.

4. A refuse container according to claim 3 wherein the output door is hinged adjacent the back panel of the container.

5. A refuse container according to claim 1 wherein the output doors are securely closed.

6. A refuse container according to claim 1 wherein the container is interiorly divided by a panel.

7. A refuse container according to claim 1 wherein the front panel doors provide access to two thirds of the interior of volume of the container and the end panel doors provide access to the remaining interior volume.

8. A multiple compartment container capable of receiving and storing refuse, a plurality of recyclable materials, sheet stock or newspapers, the container comprising:

a rectangular housing having a front panel, a back panel, a top panel, a bottom panel, and first and second end panels, said front panel comprising:

a multiplicity of downward flapping refuse input doors, said doors being hinged adjacent said top panel and;

two or more substantially larger, rectangular refuse removal doors being hinged upon one of said end panels, the other said door being hinged upon a vertical support which divides the front panel from one-half to three-fourths of the horizontal length of said front panel said front panel further comprising:

an opening located adjacent said first end panel and said top panel, said opening providing access to an interior horizontally disposed shelf;

said first end panel having an input flap door centrally hinged on said panel and a larger removal door located below said input door wherein the container is interiorly divided so that the front panel doors provide access to from one-half to three-fourths of the volume of the container and the first end panel doors provide access to the remainder of the interior volume;

said back panel comprising two vertically disposed sheets, one set inward from the back edge of the top and bottom panels, the other set adjacent the edge of the top and bottom panels so as to define a vertically disposed space located in the back of the container.

* * * * *